US006923276B2

(12) United States Patent
Overstreet et al.

(10) Patent No.: US 6,923,276 B2
(45) Date of Patent: Aug. 2, 2005

(54) STREAMLINED MILL-TOOTHED CONE FOR EARTH BORING BIT

(75) Inventors: James L. Overstreet, Tomball, TX (US); Rudolf Carl Otto Pessier, The Woodlands, TX (US); Alan J. Massey, Houston, TX (US); Jeremy K. Morgan, Midway, TX (US)

(73) Assignee: Baker Hughes Incorporated, Houston, TX (US)

( * ) Notice: Subject to any disclaimer, the term of this patent is extended or adjusted under 35 U.S.C. 154(b) by 159 days.

(21) Appl. No.: 10/369,000

(22) Filed: Feb. 19, 2003

(65) Prior Publication Data

US 2004/0159469 A1 Aug. 19, 2004

(51) Int. Cl.[7] ..... E21B 10/16
(52) U.S. Cl. ..... 175/374; 175/426
(58) Field of Search ..... 175/331, 374, 175/426

(56) References Cited

U.S. PATENT DOCUMENTS

| | | | | |
|---|---|---|---|---|
| 1,547,842 A | | 7/1925 | Stoody et al. | |
| 2,294,544 A | | 9/1942 | Garfield | |
| 3,938,599 A | | 2/1976 | Horn | |
| 4,262,761 A | | 4/1981 | Crow | |
| 4,726,432 A | | 2/1988 | Scott et al. | |
| 4,836,307 A | | 6/1989 | Keshavan et al. | |
| 4,944,774 A | | 7/1990 | Keshavan et al. | |
| 5,131,480 A | | 7/1992 | Lockstedt et al. | |
| 5,152,194 A | | 10/1992 | Keshavan et al. | |
| 5,421,423 A | * | 6/1995 | Huffstutler | 175/374 |
| 5,492,186 A | | 2/1996 | Overstreet et al. | |
| 5,516,053 A | | 5/1996 | Hannu | |
| 5,579,856 A | | 12/1996 | Bird | |
| 5,582,258 A | | 12/1996 | Tibbitts et al. | |
| 5,592,995 A | * | 1/1997 | Scott et al. | 175/374 |
| 5,663,512 A | | 9/1997 | Schader et al. | |
| 5,758,733 A | | 6/1998 | Scott et al. | |
| 5,791,423 A | | 8/1998 | Overstreet et al. | |
| 5,921,330 A | | 7/1999 | Sue et al. | |
| 5,963,775 A | | 10/1999 | Fang | |
| 5,979,575 A | | 11/1999 | Overstreet et al. | |
| 6,045,750 A | | 4/2000 | Drake et al. | |
| 6,206,115 B1 | | 3/2001 | Overstreet et al. | |
| 6,234,261 B1 | | 5/2001 | Evans et al. | |
| 6,782,959 B2 | * | 8/2004 | Minikus et al. | 175/420.1 |
| 2003/0217868 A1 | * | 11/2003 | Witman et al. | 175/426 |
| 2004/0045743 A1 | * | 3/2004 | Lockstedt et al. | 175/374 |
| 2004/0084223 A1 | * | 5/2004 | Richman | 175/374 |

* cited by examiner

*Primary Examiner*—William Neuder
(74) *Attorney, Agent, or Firm*—Bracewell & Giuliani LLP

(57) ABSTRACT

An earth-boring bit has a bit body, at least one cantilevered bearing shaft depending inwardly and downwardly from the bit body, and a cutter mounted for rotation on the bearing shaft. The cutter includes a plurality of teeth that are covered with a hardfacing layer. At least some of the teeth have a leading side that has a streamlined contour. The streamlined contour is generally conical in some of the embodiments. In others, the streamlined contour is defined by a corner between diverging inner and outer sections of the leading side.

31 Claims, 3 Drawing Sheets

Fig. 8
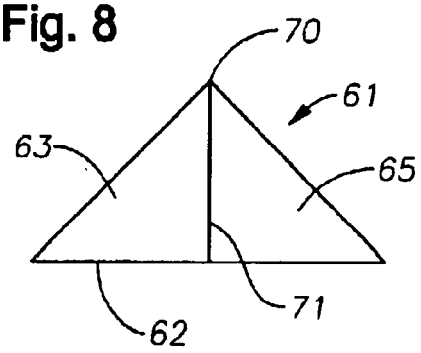
Fig. 9
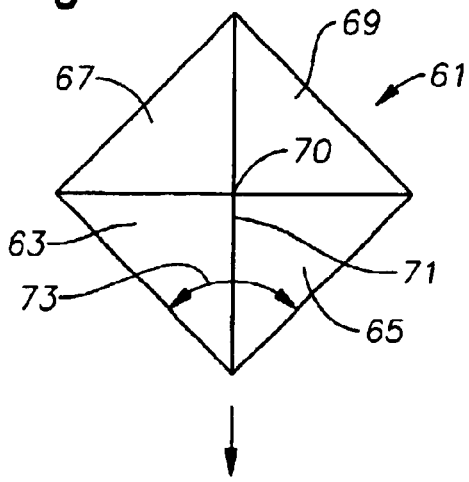
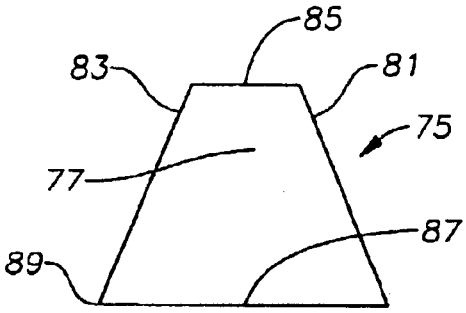
Fig. 10
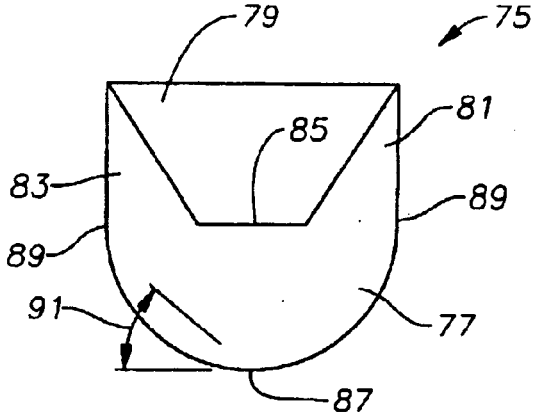
Fig. 11
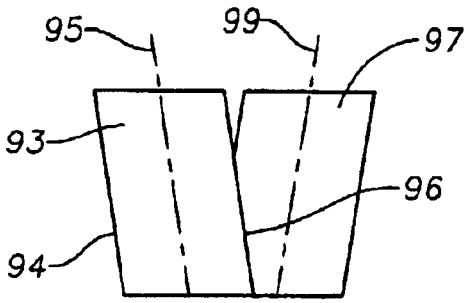
Fig. 12

STREAMLINED MILL-TOOTHED CONE FOR EARTH BORING BIT

FIELD OF THE INVENTION

This invention relates generally to earth-boring drill bits and particularly to improved cutting structures for such bits.

BACKGROUND OF THE INVENTION

In drilling bore holes in earthen formations by the rotary method, rock bits fitted with one, two, or three rolling cutters are employed. The bit is secured to the lower end of a drill string that is rotated from the surface, or the bit is rotated by downhole motors or turbines. The cutters or cones mounted on the bit roll and slide upon the bottom of the bore hole as the bit is rotated, thereby engaging and disengaging the formation material to be removed. The rolling cutters are provided with cutting elements that are forced to penetrate and gouge the bottom of the borehole by weight of the drill string. The cuttings from the bottom of the borehole are washed away by drilling fluid that is pumped down from the surface through the hollow drill string.

The earliest rolling cutter, earth boring bits had teeth machined integrally from steel, earth disintegrating cutters. These bits, typically known as "steel tooth" or "milled tooth" bits, are used for penetrating the relatively soft geological formations of the earth. The strength and fracture toughness of steel teeth enables the aggressive gouging and scraping action that is advantageous for rapid penetration of soft formations with low compressive strengths. However the same cutting structure that drills sand formations fast, slows down considerably when it encounters shales. This is due in part to the shale sticking to the bit when it cannot be readily removed by the drilling fluid because of the chisel shape of the teeth and their location on the bit.

It has been common in the arts since at least the 1930s to provide a layer of wear-resistance metallurgical material called "hardfacing" over those portions of the steel teeth exposed to the severest wear. The hardfacing typically consists of extremely hard particles, such as sintered, cast, or macrocrystalline tungsten carbide dispersed in a steel matrix. Such hardfacing materials are applied by welding a metallic matrix to the surface to be hardfaced and applying the hard particles to the matrix to form a uniform dispersion of hard particle in the matrix.

Typical milled tooth bits have their teeth milled such that the inner and outer ends and leading and trailing flanks are fairly wide flat surfaces. The flat wide surfaces normal to the direction of rotation increase the tendency for the bit to ball up when sliding in shales. Typical hardfacing deposits are welded over a steel tooth that have a shape similar to the shape of the underlying tooth.

BRIEF SUMMARY OF THE INVENTION

An earth-boring bit has a bit body and at least one cantilevered bearing shaft depending inwardly and downwardly from the bit body. A cutter is mounted for rotation on each bearing shaft wherein each cutter includes a plurality of hardfaced teeth. At least some of the teeth have a leading side that has a streamlined contour. The leading side has an advance portion that leads inner and outer portions of the leading side. The advance portion has a narrow width compared to the base of the tooth.

In one embodiment, the streamlined contour is defined by making at least the leading portion of the tooth conical. The apex is rounded, and the trailing flank may be either conical or conventional in shape. Heel row teeth can be streamlined with a conical leading and inner side. The outer or gage side may remain flat.

In another embodiment, the streamlined contour is defined by providing the leading side with a leading edge. The leading edge is formed by the corner junction of inner and outer diverging sides, which may be flat. Preferably, the included angle of the corner junction is at least 90 degrees.

Also, at least one inner row may have teeth that incline in opposite directions. Each inclined tooth has a central axis that is inclined relative to an axis of rotation of the cone. Preferably, the inclined teeth alternate with each other, with half of the teeth inclining inward and the other half inclining outward.

The teeth of the various embodiments have a crest and a base. The crest may be rounded, as in the case of an apex of a conical contour, or it may be flat. Preferably, the crest is narrow compared to the base, having a width that is less than one-third the width of the base.

In manufacturing, tooth-stubs are machined on the cutter in the desired streamlined configuration. The tooth-stubs have a hardfacing on their surfaces that is a composition of carbide particles dispersed in a metallic matrix. Each tooth-stub and the hardfacing define one of the cutting elements of the cutter.

BRIEF DESCRIPTION OF THE DRAWINGS

FIG. 8 is a front elevational view of another alternate embodiment of a tooth for the earth boring bit of FIG. 1, the tooth being a four-sided pyramid in configuration.

FIG. 9 is a top plan view of the tooth of FIG. 8.

FIG. 10 is a front elevation view of another alternate embodiment of a tooth for the earth boring bit of FIG. 1, the tooth having a leading side that is conical.

FIG. 11 is a top plan view of the tooth of FIG. 10.

FIG. 12 is a schematic view of an alternate embodiment of an inner row of teeth for the earth boring bit of FIG. 1.

DETAILED DESCRIPTION OF THE PREFERRED EMBODIMENT

Figure 1:
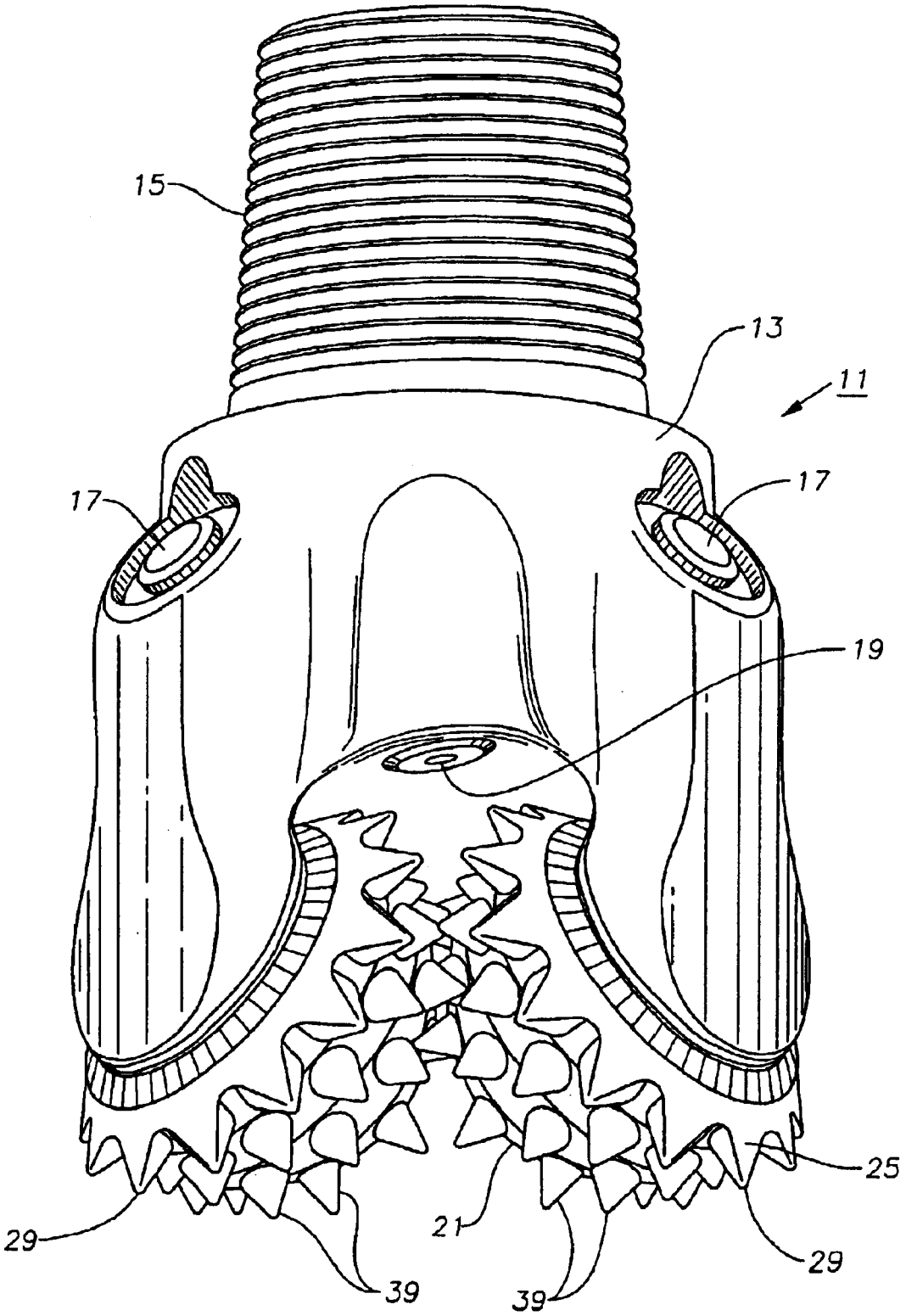
FIG. 1 is a perspective view of an earth-boring bit of the steel tooth type constructed in accordance with this invention.

Referring to FIG. 1, an earth-boring bit 11 according to the present invention is illustrated. Bit 11 includes a bit body 13 having threads 15 at its upper extent for connecting bit 11 into a drill string (not shown). Each leg of bit 11 is provided with a lubricant compensator 17. At least one nozzle 19 is provided in bit body 13 for directing pressurized drilling fluid from within the drill string to cool and lubricate bit 11 during drilling operations. At least one cutter 21 is rotatably secured to a leg of bit body 13. Typically, each bit 11 has three cutters 21, two of which are shown in FIG. 1 and another that is obscured from view in FIG. 1.

Figure 2:
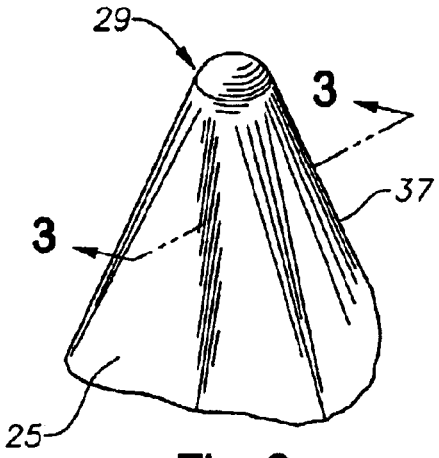
FIG. 2 is an enlarged perspective view of a heel row tooth of the earth-boring bit shown in FIG. 1.
Figure 3:
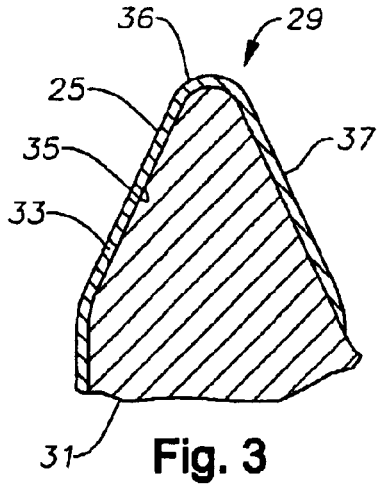
FIG. 3 is a cross sectional view, taken along the line 3—3 of FIG. 2, of the heel row tooth illustrated in FIG. 2.

Each cutter 21 has a shell surface including a gage surface 25. Heel row teeth 29 are the outermost teeth and are located at the junction of the conical surface of cutter 21 and gage surface 25. As shown in FIGS. 2 and 3, each heel row tooth 29 has an underlying support member 31, or tooth-stub, that is machined from the conical surface of cutter 21. A layer of hardfacing material 33 is welded over tooth-stub 31. Hardfacing 33 typically consists of extremely hard particles, such as sintered, cast, or macrocrystalline tungsten carbide, dispersed in a steel matrix. Hardfacing materials 33 are typically applied by welding a metallic matrix to the surface to be hardfaced and applying the hard particles to the matrix to form a uniform dispersion of hard particle in the matrix. Each heel row tooth-stub 31 has an outer end 35 that is substantially flat and flush with gage surface 25. Hardfacing 33 is applied to outer end 35 so that gage surface 25 is substantially continuous up the outer end of heel row tooth 29, as illustrated in FIG. 1.

In the embodiment shown in FIGS. 2 and 3, at least the leading portion of each heel row tooth 29 is shaped to be streamlined. The term "streamline" herein means a contour of a tooth constructed so as to offer minimum resistance to material flow. The leading side of the tooth is designed to provide less resistance than in the prior art to the flow of sticky shale and mud around the tooth as the tooth rotates and slides through the shale. The leading side is configured so that the flow vectors of the shale and mud do not make sharp turns as they pass the tooth. Generally that means that there will be little, if any, portion of the leading side that is flat and normal to the direction of rotation of the cutter. Preferably, all surfaces having any significant width on the leading side are at least 45° from a position facing into the direction of rotation.

In the embodiment of FIGS. 2 and 3, heel row tooth 29 is generally conical except for the flat outer end 35. Rather than being elongated, the crest or apex 36 is rounded and dome-shaped. The leading and trailing flanks and the inner end, referenced as inner portion 37, are rounded into the shape of a cone. Inner portion 37 forms a heel row tooth 29 that is thus partially conical in shape. The width or diameter of apex 36 is measured at the point of curvature from the sloping sides. The width or diameter of the base of tooth 29 is measured at the point where tooth 29 joins the supporting metal of cone 21, and it is measured from outer end 35 to the inner portion 37. The width of apex 36 is preferably less than one-third the width of the base.

The underlying support metal or tooth-stub 31 is formed in this partially conical shape. Hardfacing 33 is applied over tooth-stub 31, typically, in a generally uniform thickness. The leading side of conical inner portion 37 has no flat areas that might impede the flow of viscous shale and drilling mud.

Referring again to FIG. 1, a plurality of inner row teeth 39 are formed on each cutter 21 radially inward from heel row teeth 29 up to the apex of cutter 21. One of cutters 21 typically has a spear point (not shown) on its apex, another an inner row of teeth 39 (not shown) near its apex, and the third has a conical apex free of inner row teeth 39. Each cutter 21 will have one or more rows of inner row teeth 39.

Figure 4:
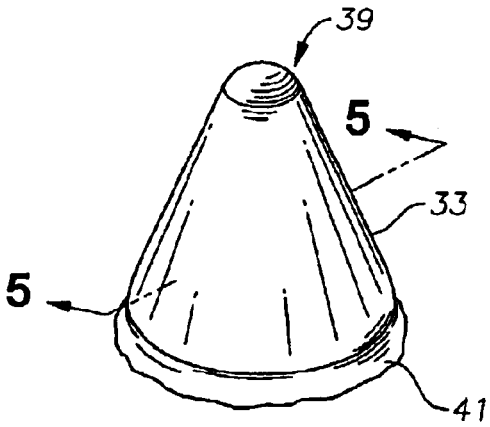
FIG. 4 is an enlarged perspective view of an inner row tooth of the earth-boring bit shown in FIG. 1.
Figure 5:
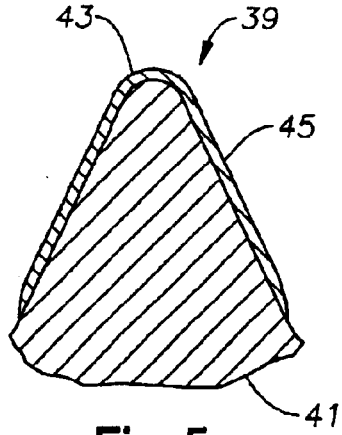
FIG. 5 is a cross sectional view, taken along the line 5—5 of FIG. 4, of the inner row tooth illustrated in FIG. 4.

Referring to FIGS. 4 and 5, at least some of the inner row teeth 39 have an underlying support metal or tooth-stub 41 that has a leading side with a streamlined configuration. Tooth-stub 41 is machined from the metal of cutters 21 and may have different shapes. In this embodiment, tooth-stub 41 is conical with a rounded apex 43. The width of apex 43 is less than one-third the width of the base of tooth-stub 41. A uniform hardfacing layer 45 is applied over tooth-stub 41. The exterior of inner row tooth 39, being conical, does not have any flat areas normal to the direction of rotation.

Figure 6:
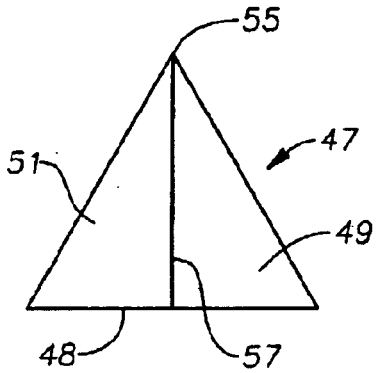
FIG. 6 is a front elevational view of an alternate embodiment of a tooth for the earth-boring bit shown in FIG. 1, the tooth being a three-sided pyramid in configuration.
Figure 7:
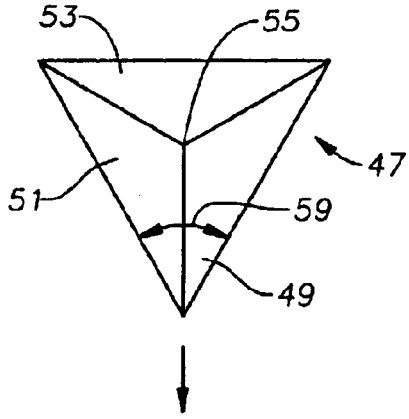
FIG. 7 is a top plan view of the tooth of FIG. 6.

Referring to FIG. 6, tooth 47 is another embodiment of an inner row tooth. Tooth 47 has a configuration of a three-sided pyramid. Tooth 47 has a base 48 that is triangular, as shown in FIG. 7. Three sides 49, 51 and 53, each being triangular, lead to an apex 55. Although apex 55 is shown as sharp, it could be truncated and rounded. If truncated or rounded, preferably the width of apex 55 will be less than one-third the width of base 48 of tooth 47. Sides 49 and 51 form the leading side of tooth 47, while side 53 trails, considering the direction of rotation or sliding indicated by the arrow. Sides 49, 51 are outer and inner portions, respectively, of the leading side. Sides 49, 51 intersect each other at an advance portion, the advance portion being a portion of tooth 47 that leads the remaining portions of tooth 47. This advance portion comprises a leading edge or corner 57 defined by the intersection of outer and inner sides 49, 51. Corner 57 is fairly sharp, thus has a width much smaller than the width of tooth 47. Outer and inner sides 49, 51 are shown to be flat, but they could be curved, either concave or convex. The included angle 59 of corner junction 57 is preferably less than 90°, and in this embodiment it is 60°. Consequently, outer and inner sides 49, 51 are oriented 60° from the direction of rotation. Tooth 47 is hardfaced as in the other embodiments.

Referring to FIGS. 8 and 9, tooth 61 is another embodiment of an inner row tooth that has the shape of a pyramid. Tooth 61 has a rectangular base 62 and four sides 63, 65, 67 and 69. Sides 63, 65 are on the leading side of tooth 61 considering the direction of rotation. Sides 67, 69 are on the trailing sides. Sides 63, 65, 67, 69 join each other at an apex 70. Apex 70 could be rounded or truncated rather than sharp as shown. Also, its width will be less than one-third the width of base 62 if truncated or rounded.

Sides 63, 65 are the inner and outer portions, respectively, of the leading side of tooth 61. Sides 63, 65 join each other at a corner junction 71. Corner junction 71 is the advance portion of tooth 61 because it leads all the remaining portions. Corner 71 is defined by the intersection of the diverging inner and outer sides 63, 65. In this embodiment the included angle 73 of corner junction 71 is 90°. Consequently, each inner and outer side 63, 65 is oriented 45° relative to the direction of rotation. Outer and inner sides 63, 65, although shown to be flat, could be concave or convex to some extent. The width of corner 71 is very small compared to the width of base 62 from corner to the other corner.

In the embodiment of FIGS. 10 and 11, tooth 75 has a leading side 77 that is conical and a trailing side 79 that is a generally flat flank. The conical leading side 77 joins an outer side 81 and an inner side 83, both of which are flat and parallel to the direction of rotation. The conical contour of leading side 77 is truncated, defining a flat crest 85. Crest 85 preferably has a width that is less than one-third the width of the base of tooth 77. The advance portion of leading side 77 is a center line 87 of conical leading side 77 that extends from the base to crest 85. Preferably, leading side 77 extends a full 180° to junctions 89 with sides 81 and 83. The angle 91 between advance center line 87 and each junction line 89 is 45°. Tooth 75 is also hardfaced in the same manner as the other embodiments.

FIG. 12 illustrates an inward inclined tooth 93 that is in an alternate embodiment row to one of the inner rows shown in FIG. 1. Inward inclined tooth 93 has a central axis 95 that extends from its base to its apex. Axis 95 is located equidistant between an inner side 94 and outer side 96 of tooth 93. Axis 95 is inclined or skewed relative to an axis of rotation rather than being in a plane perpendicular as in the prior art. Axis 95 inclines inward, and the row contains a number of similar inward inclined teeth 93.

The same row contains a number of outward inclined teeth 97. Each outward inclined tooth 97 has a central axis 99 that inclines also, but in an opposite direction from axis 95. Each axis 99 is located equidistant between the inner and outer sides of outward inclined tooth 97. The amount of inclination relative to a line that is perpendicular to the rotational axis may vary.

Preferably, each inward inclined tooth 93 alternates with one of the outward inclined teeth 97. This results in a clearance between teeth 93, 97 that is parallel to the direction of rotation to facilitate the flow of sticky shales through teeth 93, 97 of the row. Teeth 93, 97 are shown schematically, and could be conventional. Alternately, they could have streamlined contours, similar to any of the embodiments above. Although teeth 93, 97 are shown schematically to have a base and a crest that are about the same width, the crest could be much smaller than the width of the base. As in the other embodiments, the crest could have a width less than one-third the width of the base of each tooth 93 and 97.

The invention has significant advantages. Streamlined teeth as described facilitate better cuttings removal while maintaining an aggressive cutting structure. The particular shape for the teeth can vary depending on each drilling application. Not all of the inner teeth need to be the same shape. The shape of the heel row teeth can differ as well. Shapes other than conical or pyramidal are feasible.

While the invention has been shown in only a few of its forms, it should be apparent to those skilled in the art that it is not so limited, but is susceptible to various changes without departing from the scope of the invention.

We claim:

1. An earth-boring bit comprising:

a bit body;

at least one cantilevered bearing shaft depending inwardly and downwardly from the bit body;

a cutter mounted for rotation on the bearing shaft and having a plurality of teeth machined thereon that are covered with a hardfacing layer comprising particles of tungsten carbide dispersed in a metal matrix; and at least some of the teeth having a leading side that has a streamlined contour.

2. The bit of claim 1, wherein the leading side has an advance portion that leads remaining portions of the leading side.

3. The bit of claim 1, wherein at least part of the leading side is curved.

4. The bit of claim 1, wherein at least part of the leading side is conical.

5. The bit of claim 1, wherein said at least some of the teeth have a conical contour and are located in an inner row.

6. The bit of claim 1, wherein said at least some of the teeth comprise heel row teeth, the leading side of which is at least partially conical and joins an outer end that is generally flat.

7. The bit of claim 1, wherein the leading side has inner and outer portions that join each other at a junction and diverge from each other.

8. The bit of claim 1, wherein at least some of the teeth have a base and a crest, the crest having a width that is less than one-third of the width of the base.

9. An earth-boring bit comprising:

a bit body;

at least one cantilevered bearing shaft denending inwardly and downwardly from the bit body;

a cutter mounted for rotation on the bearing shaft and having a plurality of teeth formed thereon that are covered with a hardfacing layer; and at least some of the teeth having a leading side that has a streamlined contour, and inner and outer portions that join each other at a corner junction and diverge from each other, the corner junction extending from a base to an apex, and the corner junction has an included angle that is no greater than 90 degrees.

10. An earth-boring bit comprising:

a bit body;

at least one cantilevered bearing shaft depending inwardly and downwardly from the bit body;

a cutter mounted for rotation on the bearing shaft and having a plurality of teeth formed thereon that are covered with a hardfacing layer, the teeth of the cutter further comprise an inner row containing inward and outward inclined teeth, each of the inward inclined teeth having a central axis that inclines inwardly relative to an axis of rotation of the cutter, each of the outward inclined teeth having a central axis that inclines outwardly relative to an axis of rotation of the cutter; and at least some of the teeth having a leading side that has a streamlined contour.

11. An earth-boring bit comprising:

a bit body;

at least one cantilevered bearing shaft depending inwardly and downwardly from the bit body;

a cutter mounted for rotation on the bearing shaft and having a plurality of hardfaced streamlined teeth formed thereon each of the teeth having a steel tooth stub onto which a layer of hardfacing is welded, the hardfacing comprising tungsten carbide particles in a metal matrix;

each of the streamlined teeth having leading and trailing sides, and the leading side having an advance portion and inner and outer portions joining the advance portion on opposite sides and diverging from each other.

12. The bit of claim 11, wherein the advance portion and the inner and outer portions define a conical contour.

13. The bit of claim 11, wherein the inner and outer portions are generally flat.

14. The bit of claim 11, wherein the advance portion comprises a corner junction of the inner and outer portions, the corner junction having an included angle that is not more than 90 degrees.

15. The bit of claim 11, wherein at least some of the teeth have a base and a crest, the crest having a width that is less than one-third of the width of the base.

16. An earth-boring bit comprising:

a bit body;

at least one cantilevered bearing shaft depending inwardly and downwardly from the bit body;

a cutter mounted for rotation on the bearing shaft and having a plurality of hardfaced streamlined teeth formed thereon;

each of the streamlined teeth having leading and trailing sides, and the leading side having an advance portion and inner and outer portions joining the advance portion on opposite sides and diverging from each other, the advance portion and the inner and outer portions define a conical contour, and the trailing side has a generally flat flank.

17. An earth-boring bit comprising:

a bit body;

at least one cantilevered bearing shaft depending inwardly and downwardly from the bit body;

a cutter mounted for rotation on the bearing shaft and having a plurality of hardfaced streamlined teeth formed thereon;

each of the streamlined teeth having leading and trailing sides, and the leading side having an advance portion and inner and outer portions joining the advance portion on opposite sides and diverging from each other, the inner and outer portions are generally flat, and the advance portion comprises a corner junction of the inner and outer portions.

18. The bit of claim 17, wherein the teeth are generally pyramidal in shape, and the inner and outer portions define two sides of a pyramid.

19. The bit of claim 17, further comprising an inner row containing inward and outward inclined teeth, each of the inward inclined teeth having a central axis that inclines inwardly relative to an axis of rotation of the cutter, each of the outward inclined teeth having a central axis that inclines outwardly relative to an axis of rotation of the cutter.

20. An earth-boring bit comprising:

a bit body;

at least one cantilevered bearing shaft depending inwardly and downwardly from the bit body;

a cutter mounted for rotation on the bearing shaft, and a plurality of hardfaced teeth integrally formed on the cutter that have at least partially conical configurations, the teeth being steel and having a layer of hardfacing welded thereon that comprises tungsten carbide particles in a metal matrix.

21. The bit of claim 20, wherein at least some of the teeth have fully conical configurations with rounded apexes.

22. The bit of claim 20, wherein at least some of the teeth are located in a heel row and have flat outer ends, and wherein the teeth in the heel row have leading sides that are partially conical.

23. The bit of claim 20, wherein at least some of the teeth have a base and an apex, the apex having a width that is less than one-third a width of the base.

24. An earth-boring bit comprising:

a bit body;

at least one cantilevered bearing shaft depending inwardly and downwardly from the bit body;

a cutter mounted for rotation on the bearing shaft, and a plurality of hardfaced teeth formed on the cutter that have at least partially conical configurations, at least some of the teeth have leading sides that are partially conical and trailing sides that have flat surfaces.

25. The bit of claim 24, further comprising an inner row containing inward and outward inclined teeth, each of the inward inclined teeth having a central axis that inclines inwardly relative to an axis of rotation of the cutter, each of the outward inclined teeth having a central axis that inclines outwardly relative to an axis of rotation of the cutter.

26. An earth-boring bit comprising:

a bit body;

at least one cantilevered bearing shall depending inwardly and downwardly from the bit body;

a cutter mounted for rotation on the bearing shaft and having a plurality of hardfaced streamlined teeth formed thereon, each of the teeth having a steel tooth stub machined on the cutter and a layer of hardfacing comprising tungsten carbide particles in a metal matrix; and each of the streamlined teeth having a leading edge that is defined by an intersection of diverging inner and outer portions.

27. The bit of claim 26, wherein the leading edge comprises a corner junction that has an included angle of not more than 90 degrees.

28. An earth-boring bit comprising:

a bit body;

at least one cantilevered bearing shaft depending inwardly and downwardly from the bit body;

a cutter mounted for rotation on the bearing shaft and having a plurality of hardfaced streamlined teeth formed thereon; and each of the streamlined teeth having a leading edge that is defined by an intersection of diverging inner and outer portions, the inner and outer portions being generally flat.

29. The bit of claim 28, wherein each of the streamlined teeth is in the configuration of a pyramid, and the inner and outer portions define two sides of the pyramid.

30. The bit of claim 28, further comprising an inner row containing inward and outward inclined teeth, each of the inward inclined teeth having a central axis that inclines inwardly relative to an axis of rotation of the cutter, each of the outward inclined teeth having a central axis that inclines outwardly relative to an axis of rotation of the cutter.

31. An earth-boring bit comprising:

a bit body;

at least one cantilevered bearing shaft depending inwardly and downwardly from the bit body;

a cutter mounted for rotation on the bearing shaft and having a plurality of teeth machined thereon that are covered with a hardfacing layer of tungsten carbide particles in a metal matrix; and at least some of the teeth having a base and a crest, the crest having a width that is less than one-third a width of the base.

* * * * *